US006223705B1

(12) United States Patent
Sato et al.

(10) Patent No.: US 6,223,705 B1
(45) Date of Patent: May 1, 2001

(54) TWO-STROKE INTERNAL COMBUSTION ENGINE

(75) Inventors: Shigeru Sato, Saitama; Masakuni Hiroshima, Kanagawa; Mitsujiro Mochizuka; Kentaro Matsuo, both of Tokyo, all of (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/353,457

(22) Filed: Jul. 14, 1999

(30) Foreign Application Priority Data

Jul. 17, 1998 (JP) ..... 10-203750
Jul. 17, 1998 (JP) ..... 10-203751

(51) Int. Cl.[7] ..... F02B 33/04
(52) U.S. Cl. ..... 123/73 PP; 123/65 P
(58) Field of Search ..... 123/65 P, 73 PP

(56) References Cited

U.S. PATENT DOCUMENTS 4,287,860 * 9/1981 Fujikawa et al. ..... 123/73 PP
4,395,987 * 8/1983 Boyesen ..... 123/73 PP
5,490,483 * 2/1996 Tanikake et al. ..... 123/65 P
5,699,761 12/1997 Yamaguchi et al. .
5,881,687 3/1999 Sakaguchi et al. .
6,016,776 * 1/2000 Jonsson ..... 123/65 P

FOREIGN PATENT DOCUMENTS 214687 8/1941 (CH) .
937382 7/1949 (DE) .
54-13824 * 2/1979 (JP) ..... 123/65 P
64-29221 2/1989 (JP) .
09280057 10/1997 (JP) .

* cited by examiner

*Primary Examiner*—Noah P. Kamen
(74) *Attorney, Agent, or Firm*—Baker Botts L.L.P.

(57) ABSTRACT

A two-stroke internal combustion engine having a Schnürle scavenging system includes a pair of first scavenging ports and a pair of second scavenging ports. An inner horizontal scavenging angle formed close to an exhaust port and an outer horizontal scavenging angle formed remote from the exhaust port by a pair of scavenging flows blown out of the pair of the first scavenging ports are both set to an angle in the range of from 116 to 124 degrees. An inner horizontal scavenging angle formed close to the exhaust port and an outer horizontal scavenging angle formed remote from the exhaust port by a pair of scavenging flows blown out of the pair of the second scavenging ports are set to angles in the ranges of from 126 to 134 degrees and from 146 to 154 degrees, respectively.

10 Claims, 8 Drawing Sheets

TWO-STROKE INTERNAL COMBUSTION ENGINE

BACKGROUND OF THE INVENTION

The present invention relates to a small air-cooled two-stroke internal combustion engine having a displacement in the range of from about 15 cc to about 65 cc, which is suited for use in, for example, a portable small working machine such as a bush cutter or a chain saw, and in particular to a small air-cooled two-stroke internal combustion engine which is capable of minimizing hazardous components in the exhaust gas without badly affecting the output characteristics of the engine.

In view of the recent increasing concerns about environmental problems, a reduction in the amounts of hazardous components, such as HC, CO, NOx, PM (fine particles of unburnt components of oil), etc., in the exhaust gas discharged from an engine is now strongly demanded for even a small air-cooled two-stroke gasoline internal combustion engine to be used in a portable small working machine such as a bush cutter or a chain saw. For example, according to the exhaust gas control bill in California, known as CARB Tier II, it is required that, in the case of an SI (spark ignition) two-stroke internal combustion engine having a displacement of not more than 65 cc, HC+NOx should be reduced to 54 g/bhp-h or less, CO to 400 g/bhp-h or less, and PM to 1.5 g/bhp-h or less, beginning with the year 2000.

With a view to meeting such an exhaust gas regulation, the owner of the present invention have made various proposals concerning the structure of two-stroke internal combustion engines. One of them, as disclosed in Japanese Patent Unexamined Publication 9-280057, is a modification of the timing of the opening and closing of an exhaust port and a scavenging port of the cylinder by the piston in a two-stroke internal combustion engine having a Schnürle type scavenging system. In particular, the opening and closing timing is shortened in terms of crank angle as compared with that of a conventional engine, the opening and closing timing of the exhaust port by the piston being set to an angle in the range of from 100 to 120 degrees in terms of the crank angle with respect to the bottom dead center disposed therebetween, while the opening and closing timing of the scavenging port by the piston is set to an angle in the range of from 85 to 100 degrees in terms of crank angle with respect to the bottom dead center disposed therebetween.

The setting of the opening and closing timing of the exhaust port as well as of the scavenging port of the cylinder are achieved by lowering the position of the upper edge of the exhaust port as well as the position of the upper edge of the scavenging port, and at the same time, by shortening the distance between the upper edge of the exhaust port and the upper edge of the scavenging port.

According to the conventional engine of the same kind as mentioned above, the output characteristics of the engine are mainly taken into account in general, so that the opening and closing timing of the exhaust port is generally set to an angle in the range of 130 to 150 degrees, while the opening and closing timing of the scavenging port is generally set to an angle in the range of 100 to 110 degrees. However, since the opening and closing timings of these ports are to be set as mentioned above in the case of Japanese Patent Unexamined Publication H9-280057, the exhaust port and the scavenging port are opened at a delayed timing as compared with that of the conventional engine in the descending stroke, while the exhaust port and the scavenging port are closed at an advanced timing as compared with that of the conventional engine in the ascending stroke.

Therefore, the energy of combustion is sufficiently converted into a thrusting force to push the piston downward before reaching the point at which exhaust is initiated, i.e., the time when the exhaust port starts to open, thus minimizing the exhaust pressure. As a result, the scavenging air flow is prevented from being pushed back, thus making it possible to increase the flow rate of the scavenging gas flow and to effectively perform the scavenging.

Since the scavenging is performed effectively, the quantity of the blow-by of fresh gas (air-fuel mixture) through the exhaust port is minimized. As a result, the quantity of HC components in the exhaust gas are minimized and at the same time the output of the engine is improved. Furthermore, since the modification of the opening and closing timing are effected by simply changing the shapes and positions of the exhaust port and of the scavenging port, the modification does not result in an increase in the manufacturing cost of the engine.

In the ordinary two-stroke internal combustion engine having a Schnürle type scavenging system, as shown in the aforementioned Japanese Patent Unexamined Publication H9-280057 (see FIG. 3), a pair of scavenging ports 9 and 9 are formed symmetrically with respect to a longitudinal sectional plane (F) that bisects an exhaust port 10 (a so-called double flow scavenging system), thereby permitting part of the scavenging flow of the air-fuel mixture that has been injected from or blown out of the pair of scavenging ports 9 and 9 to impinge against an inner wall (cylinder bore) of the stationary cylinder. Additionally, there is also known a so-called four-flow scavenging system comprising two pairs of scavenging ports.

FIG. 8 shows one example of a conventional two-stroke internal combustion engine having a four-flow scavenging system, wherein the cylinder 2' shown therein is provided, on an exhaust port 10' side thereof, with a pair of first scavenging ports 9A', 9A' which are disposed symmetrically with respect to a longitudinal sectional plane F' that bisects the exhaust port 10' and, on the other side opposite to the exhaust port 10' thereof, with a pair of second scavenging ports 9B', 9B' which are disposed symmetrically with respect to the longitudinal sectional plane F'.

The inner horizontal scavenging angle $\alpha'$ formed close to the exhaust port 10' and the outer horizontal scavenging angle $\beta'$ formed remote from the exhaust port 10' by a pair of scavenging flows blown out of the pair of first scavenging ports 9A', 9A' are set to about 100 degrees (for example, 94 degrees) and about 120 degrees, respectively, while the inner horizontal scavenging angle $\gamma'$ formed close to the exhaust port 10' and the outer horizontal scavenging angle $\delta'$ formed remote from the exhaust port 10' by a pair of scavenging flows blown out of the pair of second scavenging ports 9B', 9B' are set to about 120 degrees and about 150 degrees, respectively. Additionally, the horizontal cross-sectional area Sa' of each of the first scavenging ports 9A', 9A' is made smaller than the horizontal cross-sectional area Sb' of each of the second scavenging ports 9B', 9B' ($Sa' < Sb'$).

In the conventional two-stroke internal combustion engine with a four-flow scavenging system, a pair of scavenging flows blown out of the pair of first scavenging ports 9A', 9A' are caused to impinge against each other, and at the same time, a pair of scavenging flows blown out of the pair of second scavenging ports 9B', 9B' are also caused to impinge against each other, so that the relative impinging velocity between these scavenging flows is doubled and the energy produced by the impingement is quadrupled as compared with the aforementioned engine having a double flow scavenging system where part of the scavenging flow of the air-fuel mixture impinges against the inner wall (cylinder bore) of the stationary cylinder.

As a result, the atomization of fuel particles in the air-fuel mixture that are not sufficiently atomized before they are blown out of each scavenging port is greatly promoted, whereby the ignitability and combustion efficiency of the air-fuel mixture are greatly improved. As a result, the exhaust gas clarification capability as well as fuel consumption of the engine are improved.

However, it is still impossible with the two-stroke internal combustion engine described above to prevent part of the fresh gas (air-fuel mixture), even if a very small amount, from directly passing through the exhaust port. Even if the quantity of so-called blow-by of fresh gas is reduced to a certain extent, the improvement obtainable is not large enough, and hence the reduction of hazardous components (in particular, HC components) in the exhaust gas discharged from the engine is not necessarily satisfactory. Furthermore, if it is desired to further reduce the quantity of blow-by according to the aforementioned prior art, it would inevitably lead to a significant deterioration of the output of the engine.

Even in the case of the aforementioned two-stroke internal combustion engine with a four-flow scavenging system, the effect of promoting the atomization of fuel particles in the air-gas mixture is not sufficient, thus leaving room for further improvement.

SUMMARY OF THE INVENTION

The present invention has been made to deal with the aforementioned problems. An object of the present invention is, therefore, to provide a two-stroke internal combustion engine, which is capable of increasing the output of the engine and at the same time, to effectively reduce hazardous components in the exhaust gas without necessitating a substantial structural modification, and which is capable of effectively promoting the atomization of fuel particles in air-fuel mixture, thereby to further improve the exhaust gas clarification capability as well as reduce fuel consumption.

With a view to attaining the aforementioned objects, the two-stroke internal combustion engine according to the present invention has a Schnürle scavenging system and comprises a pair of first scavenging ports which are disposed close to an exhaust port and symmetrically with respect to a longitudinal sectional plane that bisects the exhaust port of a cylinder, and a pair of second scavenging ports which are disposed remote from the exhaust port and symmetrically with respect to the longitudinal sectional plane F.

The inner horizontal scavenging angle formed close to the exhaust port and the outer horizontal scavenging angle formed remote from the exhaust port by a pair of scavenging flows blown out of the pair of the first scavenging ports are both set to an angle in the range of from about 116 to about 124 degrees, while the inner horizontal scavenging angle formed close to the exhaust port and the outer horizontal scavenging angle formed remote from the exhaust port by a pair of scavenging flows blown out of the pair of the second scavenging ports are set to angles in the ranges of from 126 to 134 degrees, and from 146 to 154 degrees, respectively, wherein the pair of scavenging flows blown out of the pair of the first scavenging ports are caused to impinge against each other, and the pair of scavenging flows blown out of the pair of the second scavenging ports are caused to impinge against each other.

In a preferred embodiment of the present invention, the horizontal cross-sectional area of each of the first scavenging ports is made to be larger than the horizontal cross-sectional area of each of the second scavenging ports.

In a two-stroke internal combustion engine according to the present invention, since the engine has a four-flow scavenging system comprising a pair of first scavenging ports and a pair of second scavenging ports, the relative impinging velocity between the scavenging flows is doubled and the energy produced by the impingement is quadrupled, as compared with the aforementioned engine having a double flow scavenging system where part of the scavenging flow of the air-fuel mixture is caused to impinge against the inner wall (cylinder bore) of the stationary cylinder.

As a result, the atomization of fuel particles in the air-fuel mixture that are not sufficiently atomized before they are blown out of each scavenging port is greatly promoted, whereby the ignitability and combustion efficiency of the air-fuel mixture are greatly improved. As a result, the exhaust gas clarification capability as well as fuel consumption of the engine are improved.

Additionally, the distance between the second scavenging ports and the center line of the cylinder, i.e., the distance between the second scavenging ports and the point where a pair of scavenging flows (second scavenging flows) blown out of the second scavenging ports impinge against each other becomes shorter than the distance between the first scavenging ports and the point where a pair of scavenging flows (first scavenging flows) blown out of the first scavenging ports impinge against each other. Moreover, with regard to the blowing directions of the second scavenging flows, the width of the horizontal cross-sectional area thereof (the lateral width of flow) becomes gradually narrower or contracted. As a result, the velocity of the second scavenging flows is greater than that of the first scavenging flows. Accordingly, the second scavenging flows are caused to impinge against each other earlier than the first scavenging flows, and the energy produced by the impingement of the second scavenging flows is larger than that produced by the first scavenging flows, so that the atomization of the second scavenging flows is more effectively promoted.

Unlike the conventional engine as shown in FIG. 8, the horizontal cross-sectional area of the first scavenging port is made larger than that of the second scavenging port in an engine according to the present invention. More specifically, the ratio of the horizontal cross-sectional area of the first scavenging port to that of the second scavenging port is set to 0.6 to 1.0 in the conventional engine as shown in FIG. 8, whereas in the case of the present invention, the ratio of the horizontal cross-sectional area of the first scavenging port to that of the second scavenging port is set to 1.2 to 1.0.

Since the ratio of the horizontal cross-sectional areas of the first and second scavenging ports is reversed in accordance with the present invention, as mentioned above, the following phenomenon is caused to occur. Since the second scavenging flows impinge against each other at an earlier moment than the first scavenging flows, the atomization of the second scavenging flows is caused to be promoted more than the first scavenging flows, thus making the second scavenging flows more gaseous and lighter in weight than the first scavenging flows. As a result, the gaseous second scavenging flows are pushed away from the exhaust port by the first scavenging flows, which are larger in total energy than the second scavenging flows in a manner like the flow of a small stream is pushed away by the flow of a big river, thus inevitably causing the second scavenging flows to move upward along the cylinder bore.

Being induced by the ascending flow of the second scavenging flows, the first scavenging flows are also caused to move farther upwardly, thus further minimizing the quantity of blow-by of the air-fuel mixture that passes through the exhaust port, whereby the HC components or unburnt components in the exhaust gas are more effectively reduced.

The combined scavenging flow, consisting of the first scavenging flows and the second scavenging flows, produced as a result of the impingement thereof, continues to move upwardly until it reaches the top of the cylinder and then, the movement thereof is reversed, thus forming a loop for allowing the combustion exhaust gas to be discharged from the exhaust port. Therefore, the charging efficiency is improved, thereby to enhance the output of the engine, and at the same time, the quantity of HC components in the exhaust gas per unit output is minimized.

In a preferred embodiment of the present invention, the opening and closing timing of the exhaust port by the piston is set to an angle in the range of 100 to 120 degrees in terms of crank angle with respect to a bottom dead center disposed therebetween, while the opening and closing timing of the scavenging port by the piston is set to an angle in the range of 85 to 100 degrees in terms of crank angle with the bottom dead center disposed therebetween.

When these opening and closing timings are set in this manner, both the exhaust port and the scavenging ports (the first scavenging port and the second scavenging port) are opened at a delayed timing in the descending stroke of the piston as compared with that of the conventional engine, while the exhaust port and the scavenging port are closed at an advanced timing in the ascending stroke of the piston as compared with that of the conventional engine.

Therefore, the energy of combustion is efficiently converted into a thrusting force to push the piston downward before reaching the point of initiation of exhaust, i.e., the time when the exhaust port starts to open, thus minimizing the exhaust pressure. As a result, the scavenging air flow is prevented from being pushed back, thus making it possible to increase the effective flow rate of the scavenging air flow and to effectively perform the scavenging.

Since the scavenging is performed effectively, the quantity of the blow-by of fresh gas (air-fuel mixture) through the exhaust port is further minimized. As a result, the quantity of HC components in the exhaust gas is minimized and at the same time, the output of the engine is improved. Furthermore, since the modification of the opening and closing timing is effected by simply changing the shape and position of the exhaust port and of the scavenging ports, the modification does not lead to an increase in the manufacturing cost of the engine.

It is also preferred, according to the present invention, that, for the purpose of causing a skirt portion of the piston to contact an air-fuel mixture that has been introduced from a crank chamber through first scavenging passages and second scavenging passages into the first scavenging ports and the second scavenging ports, the first scavenging passages and the second scavenging passages are respectively provided with an elevationally elongated opening below each of the first scavenging ports and the second scavenging ports with a partial wall portion being interposed therebetween, the partial wall portion having a predetermined thickness so as to make the inner diameter of the partial wall portion the same as the inner diameter of the cylinder bore.

Since the first scavenging passage and the second scavenging passage are provided, respectively, with the partial wall portion and the elevationally elongated opening in this manner, not only are the rigidity of the cylinder and the flow velocity of the scavenging flows enhanced, but also the skirt portion of the piston is caused to contact with the scavenging flow injected into the cylinder bore through the scavenging passages and the scavenging ports, thereby to cool the skirt portion of the piston. Consequently, the heat in the piston ring, the piston pin and the connecting rod bearing is also transferred, thereby cooling these portions. Because of the cooling effect, sticking of the piston ring or seizing of the piston is inhibited.

In a preferred embodiment of the present invention, the cylinder is provided at the lower circumferential wall thereof with a stiffening rib. Inasmuch as the cylinder is provided with an opening at a lower wall portion thereof, the structural strength of the cylinder tends to become weak, especially at the lower portion thereof. However, by the provision of the stiffening rib as mentioned above, the cylinder is prevented from being deformed, thus making it possible to assure the circularity of the cylinder, and hence, to minimize the frictional loss of the piston as well as of the crank shaft, thus resulting in an improvement in the output of the engine.

In a further embodiment of the two-stroke internal combustion engine according to the present invention which is provided with an exhaust port and a scavenging port, both being caused to be opened or closed by a piston, the top land of the piston is provided at a portion thereof which faces the exhaust port with an inclined surface portion which is gradually inclined, starting from a central portion of the piston and terminating at a peripheral portion of the piston, the inclined surface portion being rectangular or trapezoidal in plan view, the width at the peripheral portion thereof being substantially the same as the width of the exhaust port, and the length thereof being smaller than the radius of the cylinder bore. The length of the inclined surface portion should preferably be about ⅓ of the diameter of the cylinder bore. Since the top land of the piston is provided with an inclined surface portion as mentioned above, the scavenging port is opened or closed by the outer peripheral edge portion of the top land of the piston, whereas the exhaust port is opened or closed by the outer peripheral edge portion of the inclined surface portion.

As a result, the timing of the beginning of exhaust in terms of crank angle is advanced as compared with pistons that are not provided with such an inclined surface portion without necessitating any change in the scavenging timing, i.e., without causing an increase in the quantity of blow-by of air-fuel mixture from the exhaust port. Therefore, it is possible to enhance the output of the engine.

DESCRIPTION OF THE DRAWINGS

For a more complete understanding of the present invention, and the advantages thereof, reference may be made to the following description of an exemplary embodiment, taken in conjunction with the accompanying drawings.

DESCRIPTION OF THE EMBODIMENT

The present invention will be further explained with reference to the drawings depicting an embodiment of the present invention.

Figure 1:
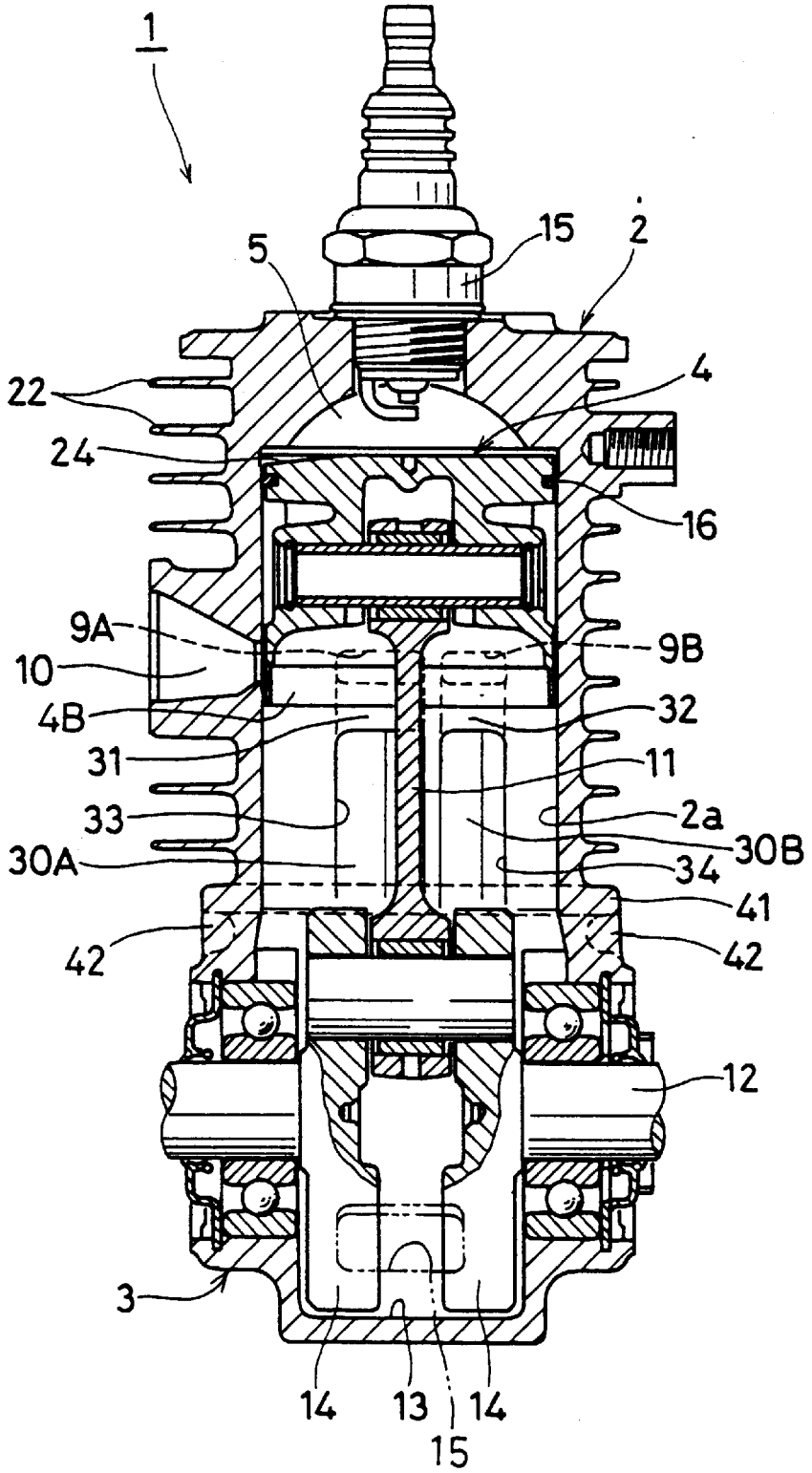
FIG. 1 is a longitudinal sectional view illustrating one embodiment of a two-stroke internal combustion engine of the present invention, the cross section being taken along the axis of the crank shaft.

FIG. 1 shows one embodiment of the two-stroke internal combustion engine according to the present invention. Referring to FIG. 1, the engine 1 is a small air-cooled two-stroke gasoline engine of Schnürle scavenging type, which is useful as a power source in a portable working machine such as a bush cutter or a chain saw, the displacement thereof being about 30 cc. The engine 1 comprises a cylinder 2 having a semi-spherical combustion chamber 5 provided with an ignition plug 15, a crank case 3 disposed below and in communication with the cylinder 2, and a piston 4 movably received in the cylinder 2. An air-fuel mixture is supplied from a carburetor (not shown) and is fed according to a known system through an intake port 15 that has a reed valve (not shown) into a crank chamber 13 disposed below the piston 4.

Figure 2:
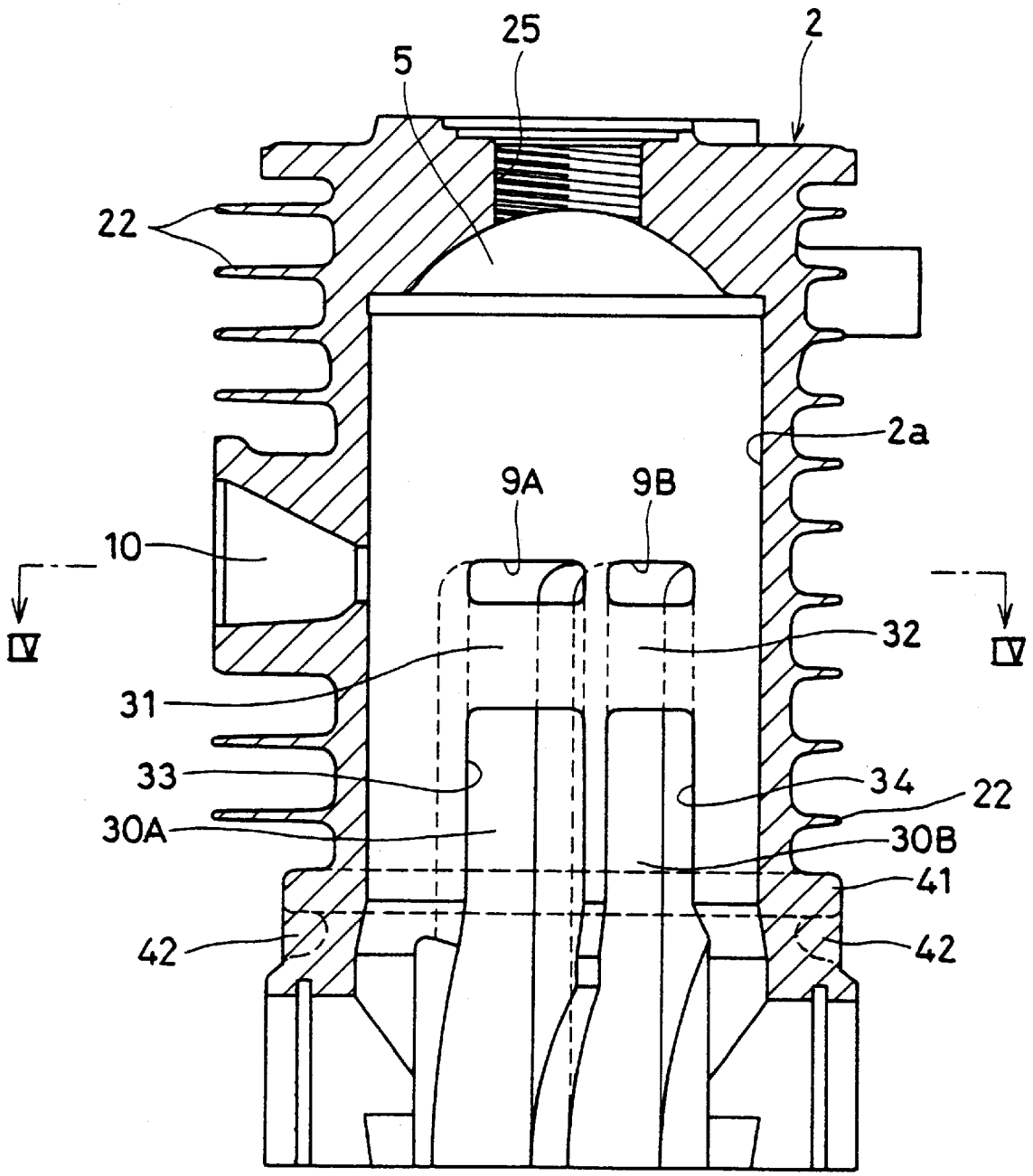
FIG. 2 is an enlarged longitudinal sectional view illustrating the cylinder portion of the two-stroke internal combustion engine shown in FIG. 1, the cross section also being taken along the axis of the crankshaft.
Figure 3:
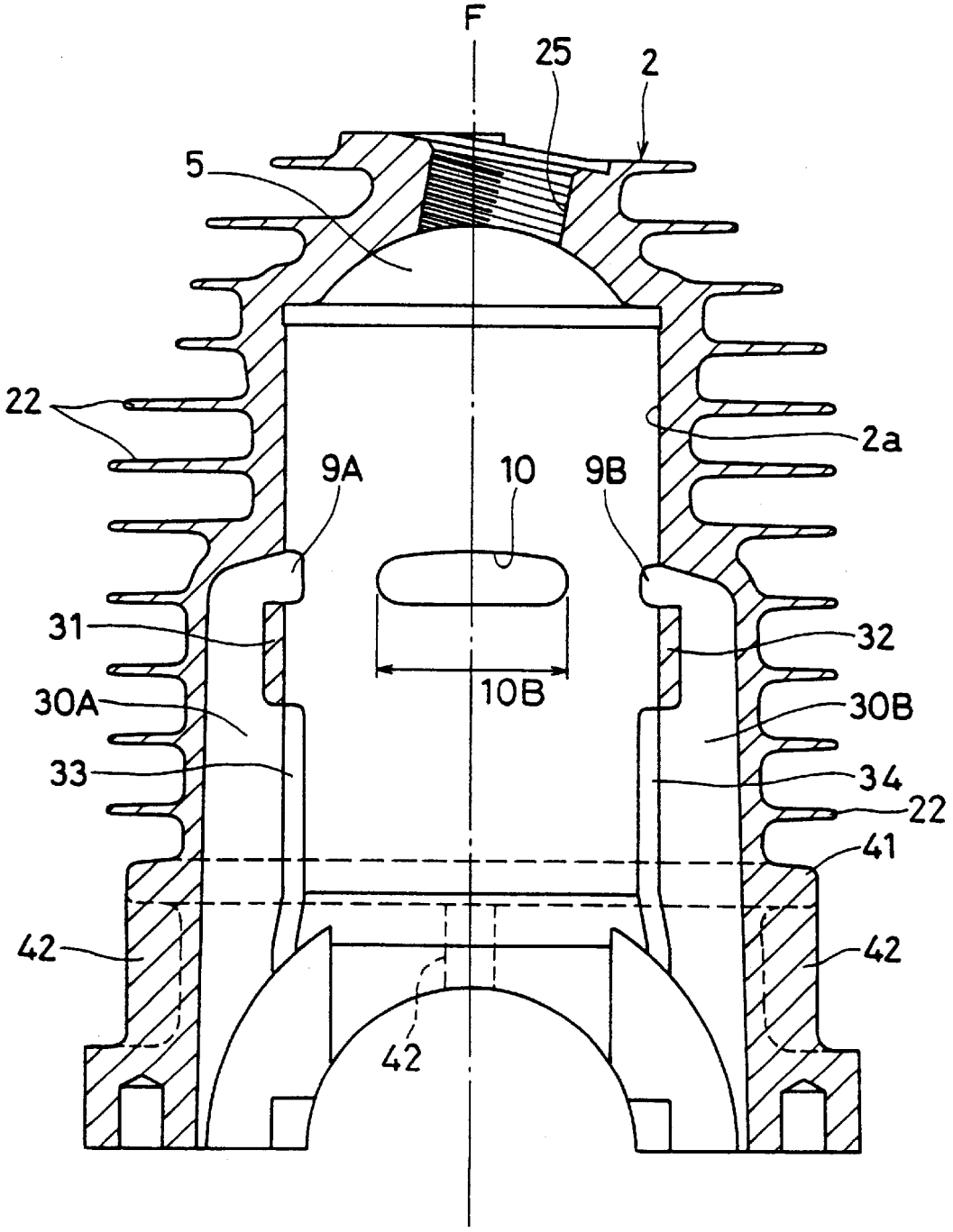
FIG. 3 is an enlarged longitudinal sectional view illustrating the cylinder portion of the two-stroke internal combustion engine shown in FIG. 1, the cross section being taken perpendicular to the crank shaft.
Figure 4:
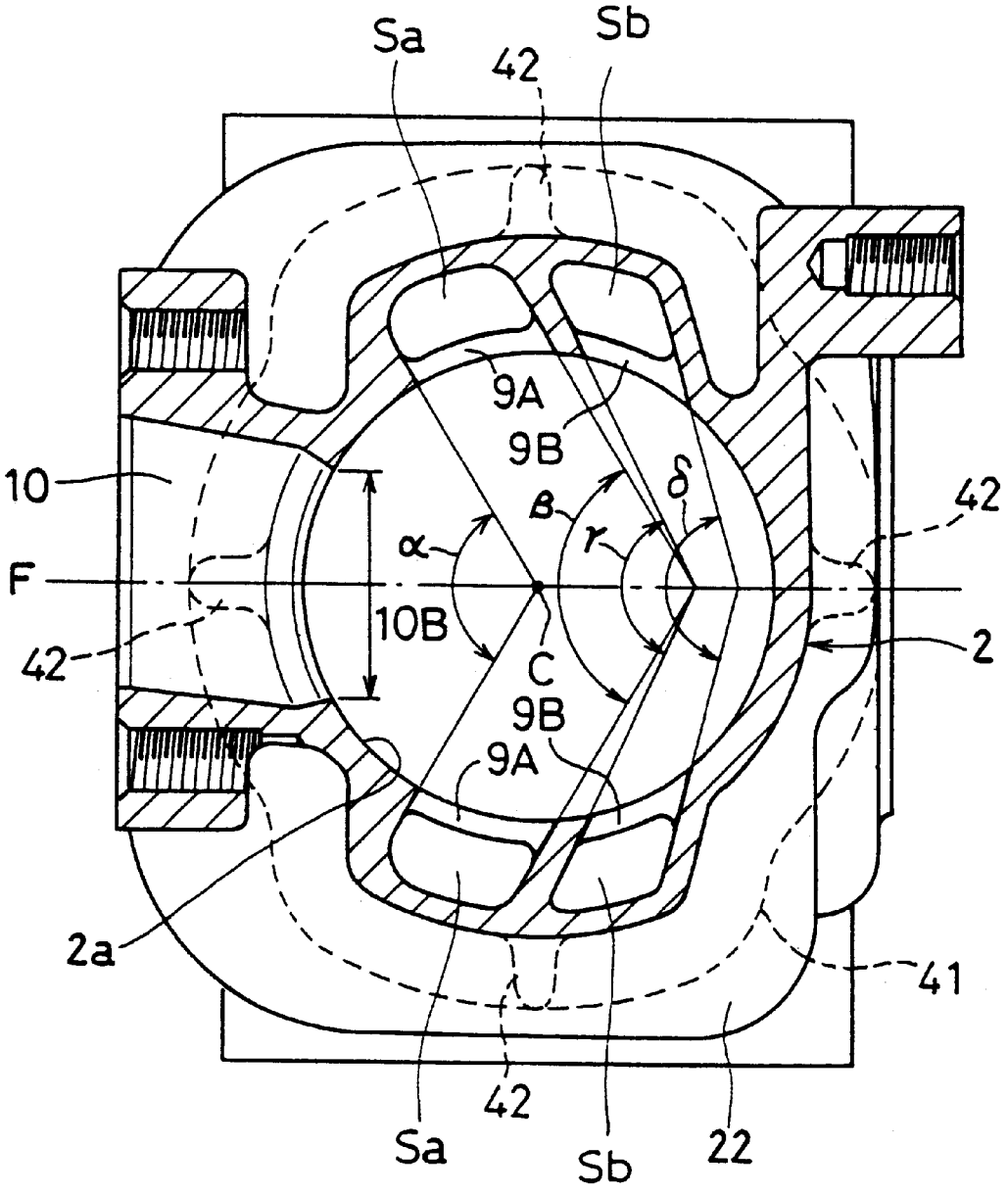
FIG. 4 is a cross-sectional view taken along the line IV—IV of FIG. 2.

As clearly shown in FIGS. 2 to 4 in addition to FIG. 1, the cylinder 2 is provided with an exhaust port 10, a pair of first scavenging ports 9A, 9A, which are located close to the exhaust port 10 and arranged symmetrically with respect to a longitudinal sectional plane F that bisects the exhaust port 10 and with a pair of second scavenging ports 9B, 9B which are disposed remote from the exhaust port 10 and symmetrically with respect to the longitudinal sectional plane F.

The reciprocating motion of the piston 4 is transmitted by a connecting rod 11 into the rotational motion of a crank shaft 12 provided with a balance weight 14, and the output of the shaft 12 is used to drive, for example, a portable working machine.

Figure 5:
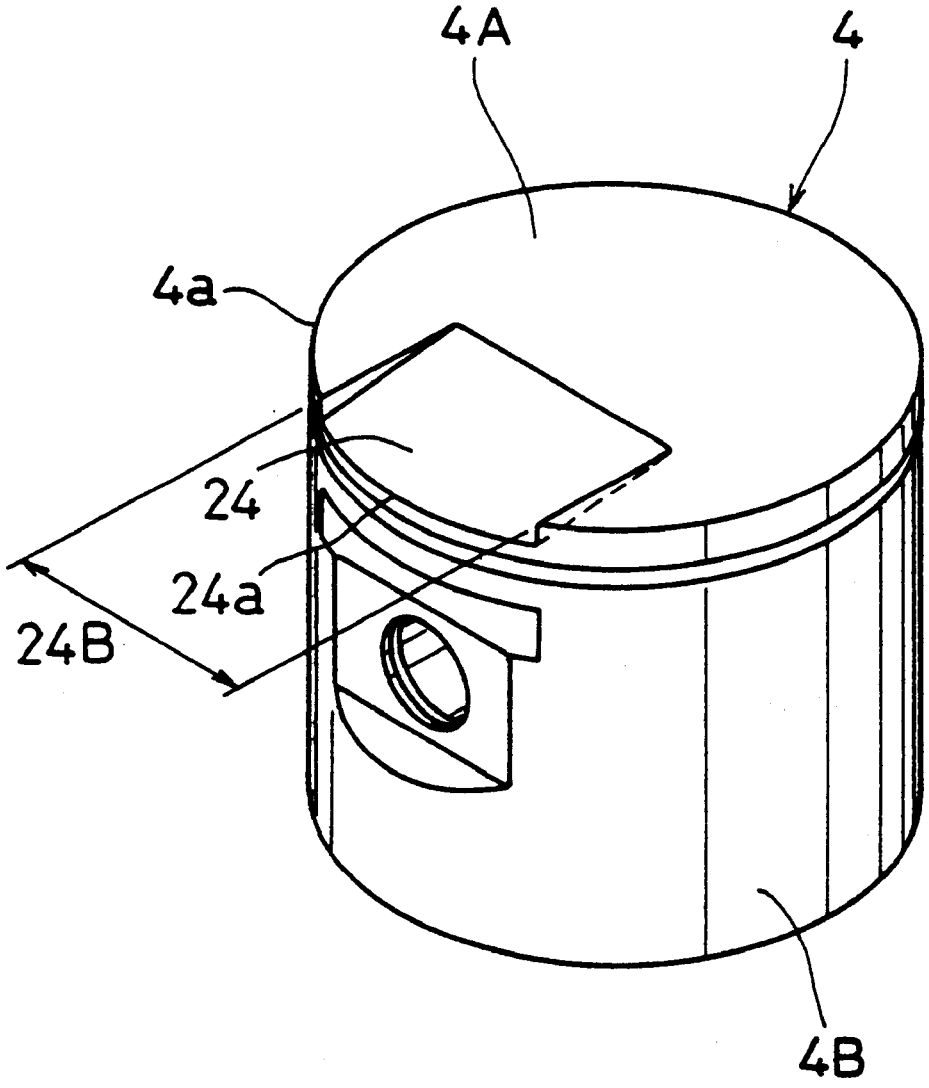
FIG. 5 is a perspective view illustrating the piston of the two-stroke internal combustion engine shown in FIG. 1.
Figure 6:
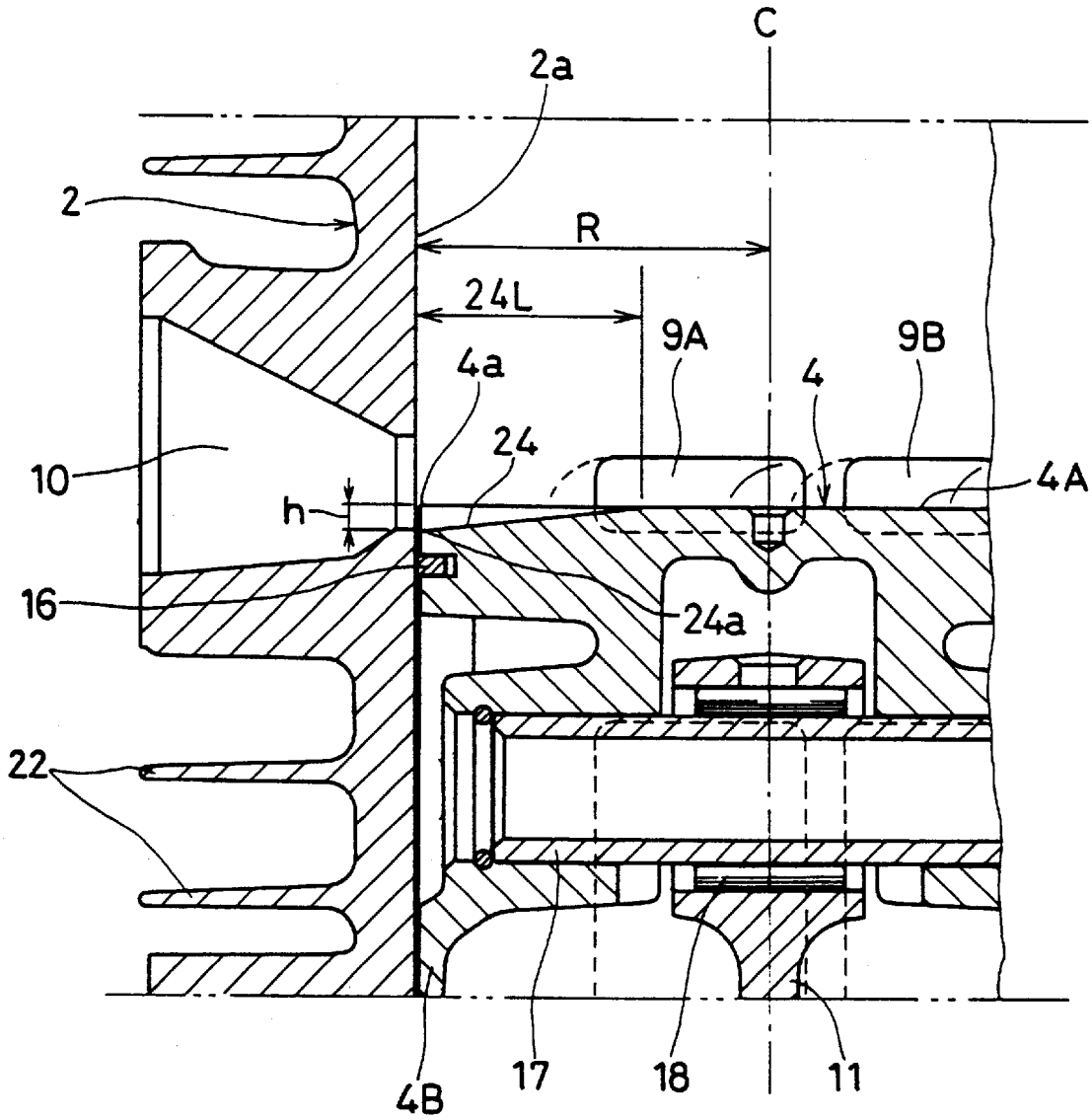
FIG. 6 is an enlarged longitudinal sectional view illustrating the exhaust port and a portion of the piston of the two-stroke internal combustion engine shown in FIG. 1.

As clearly shown in FIGS. 5 and 6 in addition to FIG. 1, a top land 4A of the piston 4 is provided at a portion thereof which faces the exhaust port 10 with an inclined surface portion 24 which is gradually inclined starting from the central portion of the piston 4 and terminating at the peripheral portion of the piston 4 (i.e., inclined by a height "h" from an outer peripheral edge 4*a* of the top land 4A), the inclined surface portion 24 being rectangular in plan view, the width 24B at the peripheral portion thereof being substantially the same as the width 10B of the exhaust port 10, and the length 24L thereof being about ⅓ of the diameter (2×R) of the cylinder bore 2*a* of the cylinder 2.

Below the pair of first scavenging ports 9A, 9A of the cylinder 2, there are provided a pair of first scavenging passages 30A, 30A for introducing an air-fuel mixture that has been inducted into the crank chamber 13 into the pair of first scavenging ports 9A, 9A, respectively. Likewise, below the pair of second scavenging ports 9B, 9B of the cylinder 2, there are provided a pair of second scavenging passages 30B, 30B for introducing an air-fuel mixture that has been inducted into the crank chamber 13 into the pair of second scavenging ports 9B, 9B, respectively.

For the purpose of causing the skirt portion 4B of the piston 4 to be contacted with the air-fuel mixture that is introduced through the first scavenging passages 30A, 30A and the second scavenging passages 30B, 30B into the first scavenging ports 9A, 9A and the second scavenging ports 9B, 9B, the first scavenging passages 30A, 30A and the second scavenging passages 30B, 30B are, respectively, provided with an elevationally elongated opening 33 or 34 below the first scavenging port 9A, 9A or the scavenging port 9B, 9B with a partial wall portion 31 or 32 being interposed therebetween, each partial wall portion 31 or 32 having a thickness of about 2 mm and a height of about 10 mm so as to make the inner diameter of the partial wall portion 31 or 32 the same as the inner diameter of the cylinder bore 2*a*.

The cylinder 2, the bottom end of which is open, is provided at the lower circumferential wall thereof with a laterally outwardly extending circumferential rib 41 as well as with a plurality of longitudinal ribs 42 (four in number in the embodiment) which are spaced apart from each other by a predetermined angle (at an angle of 90 degrees in the embodiment) and project radially outwardly a distance that is about the same as that of the cooling fins 22 of the cylinder 2 (see FIGS. 1 to 4).

In the engine 1 of the embodiment, the known ordinary phases of the strokes of two-stroke internal combustion engines—compression, combustion, suction, scavenging, expansion and exhausting—are performed synchronously with the reciprocating up-and-down movements of the piston 4.

In the embodiment, as shown in FIG. 4, the inner horizontal scavenging angle $\alpha$ formed close to the exhaust port 10 and the outer horizontal scavenging angle $\beta$ formed remote from the exhaust port 10 by a pair of the scavenging flows (first scavenging flows) blown out of the pair of the first scavenging ports 9A, 9A are both set to about 120 degrees, while the inner horizontal scavenging angle $\gamma$ formed close to the exhaust port 10 and the outer horizontal scavenging angle $\delta$ formed remote from the exhaust port 10 by a pair of scavenging flows (second scavenging flows) blown out of the pair of the second scavenging ports 9B, 9B are set to 130 degrees and 150 degrees, respectively. The pair of first scavenging flows blown out of the pair of the first scavenging ports 9A, 9A are caused to impinge against each other before they impinge against the inner wall of the cylinder (the cylinder bore 2*a*), and the pair of the second scavenging flows blown out of the pair of the second scavenging ports 9B, 9B are also caused to impinge against each other before they impinge against the inner wall of the cylinder 2 (the cylinder bore 2*a*).

The horizontal cross-sectional area Sa of each of the first scavenging ports 9A, 9A is larger than the horizontal cross-sectional area Sb of each of the second scavenging ports (Sa>Sb). Specifically, contrary to the conventional engine wherein the ratio of the horizontal cross-sectional area Sa' of the first scavenging ports 9A', 9A' to the horizontal cross-sectional area Sb' of the second scavenging ports 9B', 9B' is set to 0.6 to 1.0 for instance, the ratio of the horizontal cross-sectional area Sa of the first scavenging ports 9A, 9A to the cross-sectional area Sb of the second scavenging ports 9B, 9B according to the embodiment is set to 1.2 to 1.0 for instance.

Additionally, the opening and closing timing of the exhaust port 10 by the piston 4 is set to an angle of 110 degrees in terms of crank angle with a bottom dead center disposed therebetween, while the opening and closing timing of each scavenging port 9A, 9A or 9B, 9B by the piston 4 is set to an angle of 94 degrees in terms of crank angle with the bottom dead center disposed therebetween.

The setting of this opening and closing timing of the exhaust port 10 as well as of the scavenging ports 9A, 9A and 9B, 9B of the cylinder 2 can be achieved by lowering the position of the upper edge of the exhaust port 10 as well as the position of the upper edge of the scavenging ports 9A, 9A and 9B, 9B, and at the same time, by making the distance between the upper edge of the exhaust port 10 and the upper edge of each of the scavenging ports 9A, 9A and 9B, 9B shorter than that of the conventional engine.

According to the two-stroke internal combustion engine 1 of this embodiment, since the engine 1 is formed of a four-flow scavenging system comprising a pair of the first scavenging ports 9A, 9A and a pair of the second scavenging ports 9B, 9B, the relative impinging velocity between these scavenging flows would be doubled and the energy to be produced by this impingement would be quadrupled as compared with the aforementioned engine of double flow scavenging system where part of the scavenging flow of the air-fuel mixture is caused to impinge against the inner wall (cylinder bore) of the stationary cylinder.

As a result, the atomization of fuel particles in the air-fuel mixture that are not sufficiently atomized yet before they are blown out of each of the scavenging ports 9A, 9A and 9B, 9B is greatly promoted, whereby the ignitionability and combustion efficiency of the air-fuel mixture can be greatly improved. As a result, the exhaust gas clarification capability as well as fuel consumption of the engine can be improved.

Additionally, the distance between the second scavenging ports 9B, 9B and the center line "C" of the cylinder (FIG. 4), i.e., the distance between the second scavenging ports 9B, 9B and the point where the pair of the scavenging flows (the second scavenging flows) blown out of the second scavenging ports 9B, 9B impinge against each other becomes shorter than the distance between the first scavenging ports 9A, 9A and the point where the pair of the scavenging flows (the first scavenging flows) blown out of the first scavenging ports 9A, 9A impinge against each other. Additionally, with regard to the blowing directions of the second scavenging flows, the width of the horizontal cross-sectional area thereof (the lateral width of flow) becomes gradually narrower or contracted. As a result, the velocity of the second scavenging flows become faster than that of the first scavenging flows. Accordingly, the second scavenging flows are caused to impinge against each other earlier than the first scavenging flows, and the energy to be produced by this impingement of the second scavenging flows is larger than that to be produced by the first scavenging flows, so that the atomization of the second scavenging flows is more effectively promoted.

Figure 8:
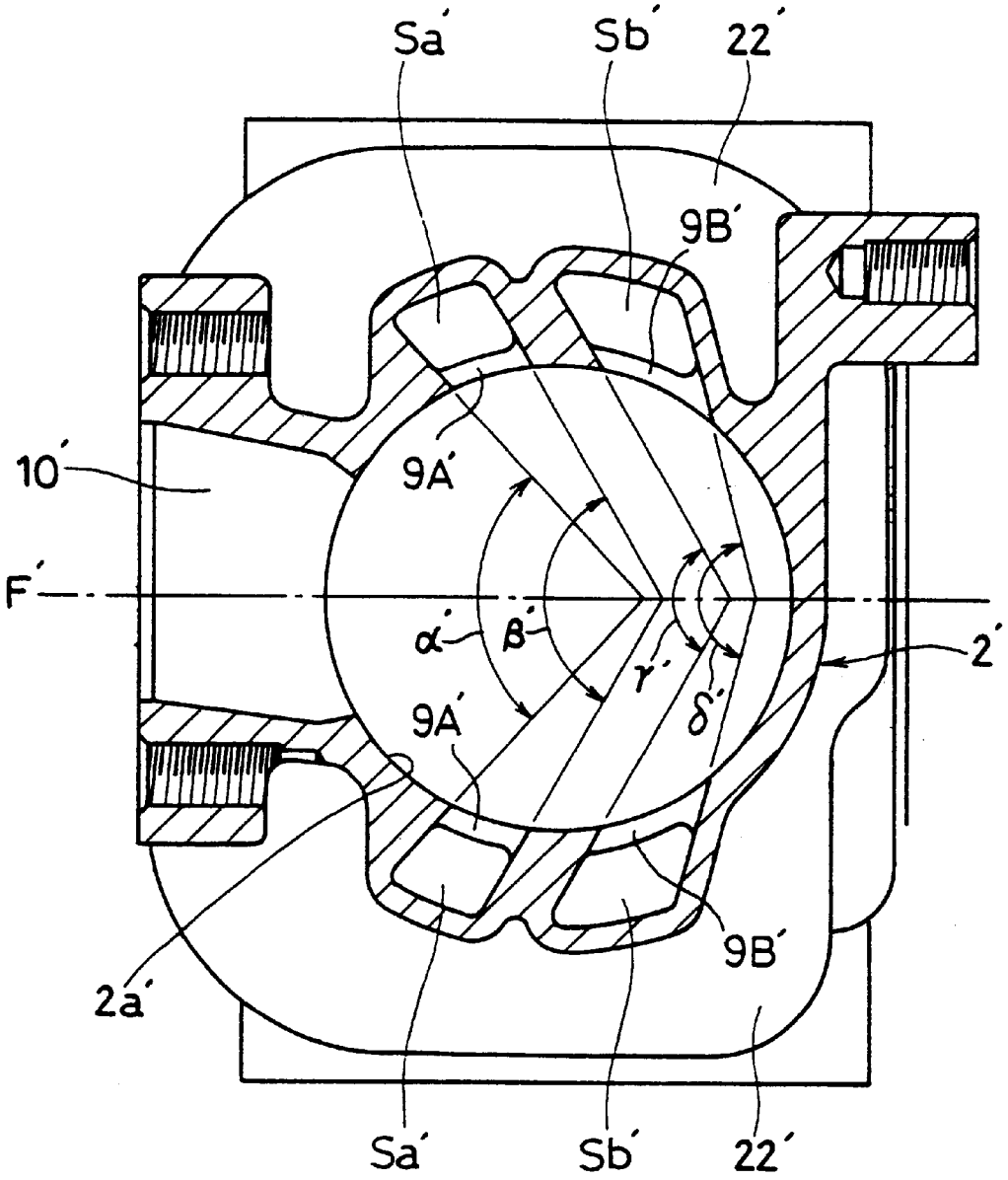
FIG.8 Prior Art
FIG. 8 is a horizontal sectional view showing one example of a conventional prior art two-stroke internal combustion engine having a four-flow scavenging system.

Further, contrary to the conventional engine as shown in FIG. 8, the horizontal cross-sectional area Sa of the first scavenging ports 9A, 9A according to this embodiment is made larger than the horizontal cross-sectional area Sb of the second scavenging ports 9B, 9B (the ratio of the Sa to Sb is set to 1.2 to 1). Therefore, the atomization of the second scavenging flows is caused to be promoted more than the first scavenging flows due to the aforementioned earlier impingement, thus making the second scavenging flows more gaseous and lighter in weight than the first scavenging flows. As a result, these gaseous second scavenging flows are pushed away from the exhaust port 10 by the first scavenging flows which are larger in the total energy than the second scavenging flows in a manner like the flow of a small stream is pushed away by the flow of a big river, thus inevitably causing the second scavenging flows to move upwardly along the cylinder bore 2*a*.

Being induced by the ascending flow of the second scavenging flows, the first scavenging flows are also caused to move farther upwardly, thus further minimizing the quantity of blow-by of the air-fuel mixture that passes through the exhaust port, whereby the HC components or unburnt components in the exhaust gas are more effectively reduced.

The combined scavenging flow, consisting of the first scavenging flows and the second scavenging flows produced as a result of the impingement thereof, continues to move upwardly until it reaches the top of the cylinder bore 2*a* and then the movement thereof is reversed, thus forming a loop for inducing the combustion exhaust gas to be discharged from the exhaust port 10. Therefore, the charging efficiency is improved, thereby to enhance the output of the engine, and at the same time, the value of HC components in the exhaust gas per unit output is minimized.

Inasmuch as the opening and closing timing of the exhaust port 10 by the piston 4 is set to an angle of about 110 degrees in terms of the crank angle with the bottom dead center disposed therebetween, while the opening and closing timing of the scavenging ports 9A, 9A and 9B, 9B by the piston 4 is set to an angle of about 94 degrees in terms of the crank angle with the bottom dead center disposed therebetween, both the exhaust port 10 and the scavenging ports (the first scavenging ports 9A, 9A and the second scavenging ports 9B, 9B) are caused to open at a delayed timing in the descending stroke of the piston 4 as compared with that of the conventional engine, while the exhaust port 10 and the scavenging ports 9A, 9A and 9B, 9B are closed at an advanced timing in the ascending stroke of the piston 4 as compared with that of the conventional engine.

Therefore, the energy of combustion is efficiently converted into a thrusting force to push the piston 4 downward before reaching the point of the beginning of exhaust, i.e., the time when the exhaust port 10 opens, thus minimizing the exhaust pressure. As a result, the scavenging air flow is prevented from being pushed back, thus making it possible to increase the effective flow rate of the scavenging air flow and to effectively perform the scavenging.

Since the scavenging is performed effectively, the quantity of the blow-by of fresh gas (air-fuel mixture) through the exhaust port 10 is further minimized. As a result, the quantity of HC components in the exhaust gas is minimized and at the same time, the output of the engine is improved. Also, since the modification of the opening and closing timing is effected by simply changing the shape and position of the exhaust port and of the scavenging port, it does not lead to an increase in the manufacturing cost of the engine. Furthermore, for the purpose of having the skirt portion 4B of the piston 4 contacted with the air-fuel mixture that has been introduced from the crank chamber 13 through the first scavenging passages 30A, 30A and the second scavenging passages 30B, 30B into the first scavenging ports 9A, 9A and the second scavenging ports 9B, 9B, the first scavenging passages 30A, 30A and the second scavenging passages 30B, 30B are, respectively, provided with the elevationally elongated openings 33 or 34 below each of the first scavenging ports 9A, 9A and the second scavenging ports 9B, 9B with the partial wall portion 31 or 32 being interposed therebetween, the partial wall portion 31 or 32 having a predetermined thickness so as to make the inner diameter of the partial wall portion 31 or 32 the same as the inner diameter of the cylinder bore 2*a*. As a result, not only are the rigidity of the cylinder 2 and the flow velocities of the first and second scavenging flows enhanced, but also the skirt portion 4B of the piston 4 is caused to directly contact with the scavenging flow that is blown into the cylinder bore 2*a* from the first scavenging ports 9A, 9A and the second scavenging ports 9B, 9B through the first scavenging passages 30A, 30A and the second scavenging passages 30B, 30B, thereby to cool the skirt portion 4B of the piston 4. As a result, the heat in the piston ring 16, the connecting rod bearing 18, and the piston pin 17 (FIG. 6) is also caused to be transferred, thereby effectively cooling these portions. Because of the cooling effect, sticking of the piston ring 16 or seizing of the piston 4 is inhibited.

Since the cylinder 2 is open at a lower wall portion thereof, the structural strength of the cylinder 2 tends to become weak, especially at the lower portion thereof. However, since the cylinder 2 is provided at the lower circumferential wall thereof with the outwardly projecting circumferential rib 41 and with the plurality of longitudinal ribs 42 which are spaced apart from each other by a predetermined angle, the cylinder 2 is prevented from being deformed, thus making it possible to assure the circularity of the cylinder 2, and hence, to minimize the frictional loss of the piston 4 as well as of the crank shaft 12, thus resulting in an improvement of the output of the engine 1. Because the top land 4A of the piston 4 is provided at a portion thereof which faces the exhaust port 10 with the inclined surface portion 24 which is gradually inclined starting from the central portion of the piston 4 and terminating at the peripheral portion 4*a* of the piston 4, the inclined surface portion 24 being rectangular or trapezoidal in plan view, the width 24B at the peripheral portion 4*a* thereof being almost equivalent to the width 10B of the exhaust port 10, and the length 24L thereof being about ⅓ of the diameter (2×R) of the cylinder bore 2*a*, the scavenging ports 9A, 9A and 9B, 9B are opened or closed by the outer peripheral edge portion 4*a* of the top land (the top surface) 4A of the piston 4, whereas the exhaust port 10 is caused to be opened or closed by the outer peripheral edge portion 24*a* of the inclined surface portion 24. As a result, the timing of the beginning of the exhaust phase is advanced as compared with that of an engine in which the piston is not provided with such an inclined surface portion without necessitating any change in the scavenging timing, i.e., without causing an increase in the quantity of blow-by of air-fuel mixture from the exhaust port 10. Therefore, it is possible to enhance the output of the engine 1.

Figure 7:
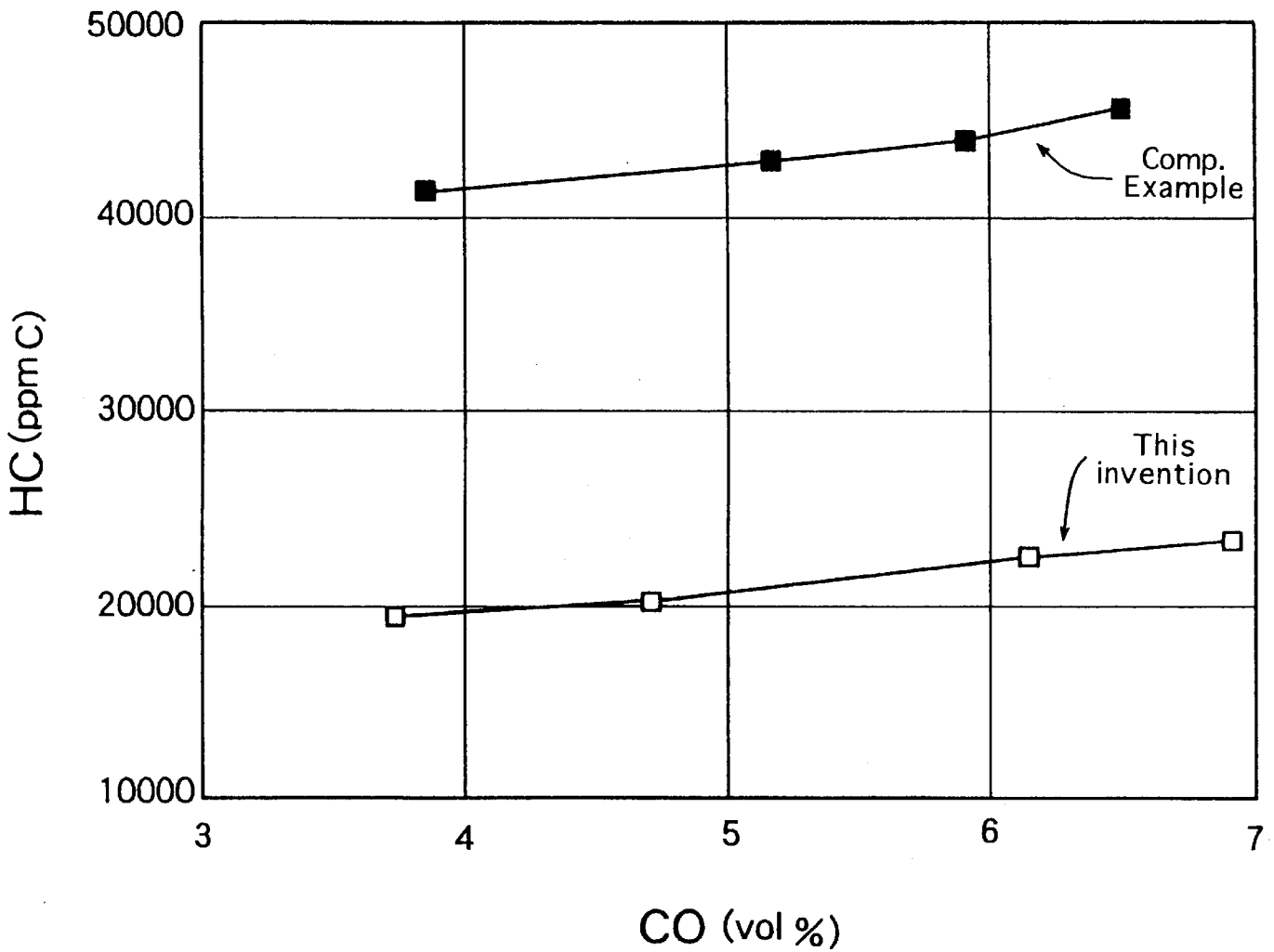
FIG. 7 is a graph showing the results of tests to determine the HC components in the exhaust gases from the two-stroke internal combustion engine shown in FIG. 1 (the present invention) and the engine shown in FIG. 8 (comparative product)

In order to confirm the aforementioned effects of the present invention, the engine 1 of the embodiment (the product of the present invention) and the conventional engine as shown in FIG. 8 (the product of comparative example) were prepared and tested under the same conditions, the results of the tests being shown in FIG. 7. The product of comparative example was constructed such that the inner horizontal scavenging angle α' formed close to the exhaust port 10' and the outer horizontal scavenging angle β' formed remote from the exhaust port 10' by a pair of scavenging flows blown out of the pair of a first scavenging ports 9A', 9A' were set to about 100 degrees (for example, 94 degrees) and about 120 degrees, respectively, while the inner horizontal scavenging angle α' formed close to the exhaust port 10' and the outer horizontal scavenging angle δ' formed remote from the exhaust port 10' by a pair of scavenging flows blown out of the pair of a second scavenging ports 9B', 9B' were set to about 120 degrees and about 150 degrees, respectively, wherein the horizontal cross-sectional area Sa' of each of the first scavenging ports 9A', 9A' was set smaller than the horizontal cross-sectional area Sb' of each of the second scavenging ports 9B', 9B' (Sa'<Sb'). As clearly seen from FIG. 7, according to the product of the present invention, the HC components in the exhaust gas are greatly minimized (a reduction of about 57%) as compared with the product of comparative example. While in the foregoing one embodiment of the present invention has been explained in detail for the purpose of illustration, it will be understood that the construction of the device can be varied without departing from the spirit and scope of the invention.

As clearly understood from the above description, it is now possible according to the present invention to provide a two-stroke internal combustion engine, which is capable of providing an increased output, and at the same time to effectively reduce hazardous components in the exhaust gas without necessitating a substantial structural modification, and which is capable of effectively promoting the atomization of fuel particles in the air-fuel mixture, thereby to further improve the exhaust gas clarification capability as well as reduce fuel consumption.

What is claimed is:

1. A two-stroke internal combustion engine having a Schnürle scavenging system, comprising a pair of first scavenging ports which are disposed close to an exhaust port and symmetrically with respect to a longitudinal sectional plane (F) that bisects the exhaust port of a cylinder, and a pair of second scavenging ports which are disposed remote from the exhaust port and symmetrically with respect to the longitudinal sectional plane (F), the first and second scavenging ports being the sole scavenging ports of the scavenging system;

wherein an inner horizontal scavenging angle formed close to the exhaust port and an outer horizontal scavenging angle formed remote from the exhaust port by a pair of scavenging flows blown out of the pair of the first scavenging ports are both set to an angle in the range of from 116 to 124 degrees, and an inner horizontal scavenging angle formed close to the exhaust port and an outer horizontal scavenging angle formed remote from the exhaust port by a pair of scavenging flows blown out of the pair of second scavenging ports are set to angles in the ranges of from 126 to 134 degrees and from 146 to 154 degrees, respectively; and wherein said pair of scavenging flows blown out of the pair of the first scavenging ports are caused to impinge against each other, and said pair of scavenging flows blown out of the pair of the second scavenging ports are caused to impinge against each other.

2. The two-stroke internal combustion engine according to claim 1, wherein a horizontal cross-sectional area of each of the first scavenging ports is larger than a horizontal cross-sectional area of each of the second scavenging ports.

3. The two-stroke internal combustion engine according to claim 2, wherein the opening and closing timing of the exhaust port by a piston is set to an angle in the range of 100 to 120 degrees in terms of the crank angle with respect to a bottom dead center disposed therebetween, and the opening and closing timing of the scavenging ports by the piston is set to an angle in the range of 85 to 100 degrees in terms of the crank angle with respect to the bottom dead center disposed therebetween.

4. The two-stroke internal combustion engine according to claim 1, wherein the opening and closing timing of the exhaust port by a piston is set to an angle in the range of 100 to 120 degrees in terms of the crank angle with respect to a bottom dead center disposed therebetween, and the opening and closing timing of the scavenging ports by the piston is set to an angle in the range of 85 to 100 degrees in terms of the crank angle with respect to the bottom dead center disposed therebetween.

5. The two-stroke internal combustion engine according to claim 1, wherein, for the purpose of causing a skirt portion of a piston to be contacted with an air-fuel mixture that has been introduced from a crank chamber through first scavenging passages and second scavenging passages into the first scavenging ports and the second scavenging ports, said first scavenging passages and said second scavenging passages are respectively provided with an elevationally elongated opening below each of said first scavenging ports and said second scavenging ports with a partial wall portion being interposed therebetween, the partial wall portion having a predetermined thickness so as to make the inner diameter of the partial wall portion the same as the inner diameter of the cylinder bore.

6. The two-stroke internal combustion engine according to claim 1, wherein said cylinder is provided at the lower circumferential wall thereof with a stiffening rib.

7. The two-stroke internal combustion engine according to claim 1, and further comprising a piston and wherein a top land of the piston is provided at a portion thereof which faces the exhaust port with an inclined surface portion which is gradually inclined starting from a central portion of the piston and terminating at a peripheral portion of the piston, the inclined surface portion being rectangular or trapezoidal in plan view, the width at the peripheral portion thereof being substantially equal to the width of the exhaust port, and the length thereof being smaller than a radius of the cylinder bore.

8. The two-stroke internal combustion engine according to claim 7, wherein the length of the inclined surface portion is about ⅓ of the diameter of the cylinder bore.

9. The two-stroke internal combustion engine according to claim 7, wherein the opening and closing timing of the exhaust port by the piston is set to an angle in the range of 100 to 120 degrees in terms of the crank angle with respect to a bottom dead center disposed therebetween, and the opening and closing timing of the scavenging port by the piston is set to an angle in the range of 85 to 100 degrees in terms of the crank angle with respect to the bottom dead center disposed therebetween.

10. The two-stroke internal combustion engine according to claim 7, wherein, for the purpose of rendering a skirt portion of the piston to be contacted with an air-fuel mixture that has been introduced from a crank chamber through first scavenging passages and the second scavenging passages into the first scavenging ports and the second scavenging ports, said first scavenging passages and said second scavenging passages are respectively provided with an elevationally elongated opening below each of said first scavenging ports and said second scavenging ports with a partial wall portion being interposed therebetween, the partial wall portion having a predetermined thickness so as to make the inner diameter of the partial wall portion the same as the inner diameter of the cylinder bore.

* * * * *